US008189821B2

(12) United States Patent
Akino

(10) Patent No.: US 8,189,821 B2
(45) Date of Patent: May 29, 2012

(54) CONDENSER MICROPHONE UNIT

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 251 days.

(21) Appl. No.: 12/801,189

(22) Filed: May 27, 2010

(65) Prior Publication Data

US 2010/0316243 A1 Dec. 16, 2010

(30) Foreign Application Priority Data

Jun. 11, 2009 (JP) ..... 2009-139977

(51) Int. Cl.
*H04R 25/00* (2006.01)

(52) U.S. Cl. ..... 381/174; 381/111; 381/113; 381/355

(58) Field of Classification Search ..... 381/111, 381/113, 355, 361, 174
See application file for complete search history.

(56) References Cited

U.S. PATENT DOCUMENTS 6,044,160 A * 3/2000 Norris ..... 381/191
7,088,839 B2 * 8/2006 Geschiere et al. ..... 381/368
7,206,428 B2 * 4/2007 Geschiere et al. ..... 381/368
7,433,484 B2 * 10/2008 Asseily et al. ..... 381/355
7,715,583 B2 * 5/2010 Van Halteren et al. ..... 381/361
7,904,180 B2 * 3/2011 Juola et al. ..... 607/142
2004/0236176 A1 * 11/2004 Asnes ..... 600/25
2008/0292125 A1 * 11/2008 Asnes ..... 381/326
2010/0316243 A1 * 12/2010 Akino ..... 381/361
2011/0013801 A1 * 1/2011 Akino ..... 381/361
2011/0142264 A1 * 6/2011 Akino ..... 381/174

* cited by examiner

*Primary Examiner* — David S. Warren
(74) *Attorney, Agent, or Firm* — Manabu Kanesaka

(57) ABSTRACT

There is provided a condenser microphone unit incorporating a FET (impedance converter) in a unit case, in which the electromagnetic shield on the rear surface side of the unit case is assured, sound waves do not leak, and a steady internal stress is applied to incorporated parts almost uniformly. In a condenser microphone unit 1A including a unit case 2 that has a front acoustic terminal hole 21 on the front end surface side thereof and is open on the rear end surface side thereof, in which the unit case 2 incorporates an acousto-electric converter 3 including a diaphragm 31 and a backplate 33, which are arranged so as to face each other via a spacer member 35, and a FET 4; a circuit board 5 is disposed in an opening part 22 on the rear end surface side of the unit case 2; and the incorporated parts 3 and 5 are fixed into the unit case 2 by staking an edge 221 of the opening part 22, an elastic disc-shaped gel-form ferrite sheet 8 having an outside diameter approximately equal to the inside diameter of the unit case 2 is held between the rear surface side of the acousto-electric converter 3 and the circuit board 5.

4 Claims, 2 Drawing Sheets

CONDENSER MICROPHONE UNIT

CROSS-REFERENCE TO RELATED APPLICATION

The present application is based on, and claims priority from, Japanese Application Serial Number JP2009-139977, filed Jun. 11, 2009, the disclosure of which is hereby incorporated by reference herein in its entirety.

TECHNICAL FIELD

The present invention relates to a condenser microphone unit and, more particularly to a technique for preventing noise produced by extraneous electromagnetic waves.

BACKGROUND ART

For a condenser microphone unit, incorporated parts are fixed to a unit case by staking (curling) or the like means. The microphone unit of this type incorporates an impedance converter. For example, Japanese Patent Application Publication No. 2006-287326 has disclosed a condenser microphone unit of this type. A conventional example of the condenser microphone unit is explained with reference to FIGS. 3 and 4. FIG. 3 is a sectional view showing a state before the unit case is staked, and FIG. 4 is a sectional view showing a state after the unit case has been staked.

As shown in FIG. 3, this condenser microphone unit 1 has a bottomed cylindrical unit case 2, and an acousto-electric converter 3 is accommodated in the unit case 2.

The unit case 2 is formed by a press-molded product of a metallic material such as aluminum, and is provided with a front acoustic terminal 21 on the front end surface side thereof (the surface side directed to the sound source side when sound is picked up) corresponding to a bottom part. The rear end surface side of the unit case 2 forms an opening part 22 through which the acousto-electric converter 3 is accommodated. This condenser microphone unit 1 is ominidirectional because of having no rear acoustic terminal.

The acousto-electric converter 3 includes a diaphragm 31 stretchedly provided on a support ring (diaphragm ring) 32 and a backplate 33 fixed on the front surface side (in FIG. 3, on the lower surface side) of a cylindrical insulating seat 34 formed of a synthetic resin, and the diaphragm 31 and the backplate 33 are disposed so as to face each other via a spacer ring 35.

In the opening part 22 on the rear end surface side of the unit case 2, a circuit board 5 is disposed so as to close the opening part 22. Although not shown in the figures, the circuit board 5 is formed with solder lands to which a drain electrode 42 and a source electrode 43, described later, are soldered and a ground (earth) pattern, to which a feeder line, a signal line, and a shield braided wire (all not shown) of a microphone cable, not shown, are connected.

This condenser microphone unit 1 includes a FET 4 serving as an impedance converter. In this example, a recess 341 is formed in the insulating seat 34, and the FET 4 is accommodated in the recess 341. The FET 4 is sometimes mounted on the inner surface side of the circuit board 5.

A gate electrode 41 of the FET 4 is electrically connected to the backplate 33, and the drain electrode 42 and the source electrode 43 are soldered to the predetermined solder lands of the circuit board 5. In FIGS. 3 and 4, only one of the drain electrode 42 and the source electrode 43 is shown in the figures because these elements are located at lapping positions on the drawing.

The condenser microphone unit 1 is assembled as described below. First, the acousto-electric converter 3 is housed in the unit case 2, thereafter a rubber ring 6 being displaced on the rear surface side (in FIG. 3, on the upper surface side) of the insulating seat 34, and the circuit board 5 is disposed on the rubber ring 6 while the drain electrode 42 and the source electrode 43 are inserted therethrough.

Then, after an edge 221 of the opening part 22 on the rear surface side is staked while being curled toward the inside as shown in FIG. 4, the drain electrode 42 and the source electrode 43 are soldered to the circuit board 5. Thereby, the rubber ring 6 is compressed to a proper degree, and the incorporated parts including the acousto-electric converter 3 and the circuit board 5 are fixed in the unit case 2.

As described above, the condenser microphone unit 1 incorporates the FET 4. Therefore, for example, when a cellular phone is used near the microphone, high-frequency signals produced by considerably strong electromagnetic waves radiated from the cellular phone are detected by the FET 4, so that noise of audible frequency may be generated.

To prevent the noise generation, in this conventional example, the FET 4 is sealed by a sealant material 7 for preventing EMI.

However, if large amounts of strong electromagnetic waves radiated from the cellular phone or the like are applied to the microphone cable connected to the circuit board 5, a high-frequency current caused by the applied electromagnetic waves may intrude into the unit case 2 through the microphone cable, and may be detected by the FET 4. Therefore, the problem that noise of audible frequency is generated is not yet solved.

Besides the above-described problem, there arises another problem that some of sound waves entering through the front acoustic terminal 21 may leak. The reason for this is that though the opening part 22 on the rear surface side of the unit case 2 is sealed by the compression of the rubber ring 6, a space is present on the inside of the rubber ring 6, or that the airtightness between the outer peripheral surface of the rubber ring 6 and the inner peripheral surface of the unit case 2 is insufficient in some cases.

Also, there arises a still another problem that since the rubber ring 6 is partially in contact with the incorporated parts, a steady internal stress cannot be applied especially to the acousto-electric converter 3 uniformly in some cases.

Accordingly, an object of the present invention is to provide a condenser microphone unit incorporating a FET (impedance converter) in a unit case, in which the electromagnetic shield on the rear surface side of the unit case is assured, sound waves do not leak, and a steady internal stress is applied to incorporated parts almost uniformly.

SUMMARY OF THE INVENTION

To achieve the above objects, the present invention provides a condenser microphone unit including a unit case that has a front acoustic terminal hole on the front end surface side thereof and is open on the rear end surface side thereof, in which the unit case incorporates an acousto-electric converter including a diaphragm stretchedly provided on a support ring and a backplate supported on the front surface side of an insulating seat, the diaphragm and the backplate being arranged so as to face each other via a spacer member, and an impedance converter; a circuit board is disposed in an opening part on the rear end surface side of the unit case; and incorporated parts including the acousto-electric converter and the circuit board are fixed into the unit case by staking an edge of the opening part, wherein an elastic gel-form ferrite sheet having an outside diameter approximately equal to the inside diameter of the unit case is held between the insulating seat and the circuit board.

According to a preferable mode of the present invention, the impedance converter is disposed in the insulating seat, and a predetermined electrode lead of the impedance converter is connected to the circuit board through the gel-form ferrite sheet.

It is preferable that a condenser element for high-frequency short circuit be mounted on the circuit board.

The present invention embraces a mode in which instead of the staking of the edge of the opening part, a lock ring threadedly engaged with the unit case is used to fix the incorporated parts into the unit case.

According to the present invention, since the elastic gel-form ferrite sheet having an outside diameter approximately equal to the inside diameter of the unit case is held between the insulating seat of the acousto-electric converter and the circuit board, the intrusion of a high-frequency current caused by extraneous electromagnetic waves can be inhibited by the magnetism (inductance) that the gel-form ferrite sheet has.

Also, since the gel-form ferrite sheet is elastic, at the time of fixation accomplished by staking or the like means, a steady internal stress can be applied to the incorporated parts almost uniformly. Also, since the gel-form ferrite sheet spreads in the radial direction due to compression, the opening part on the rear surface side of the unit case is sealed airtightly, and sound waves can be preventing from leaking.

DETAILED DESCRIPTION

Figure 3:
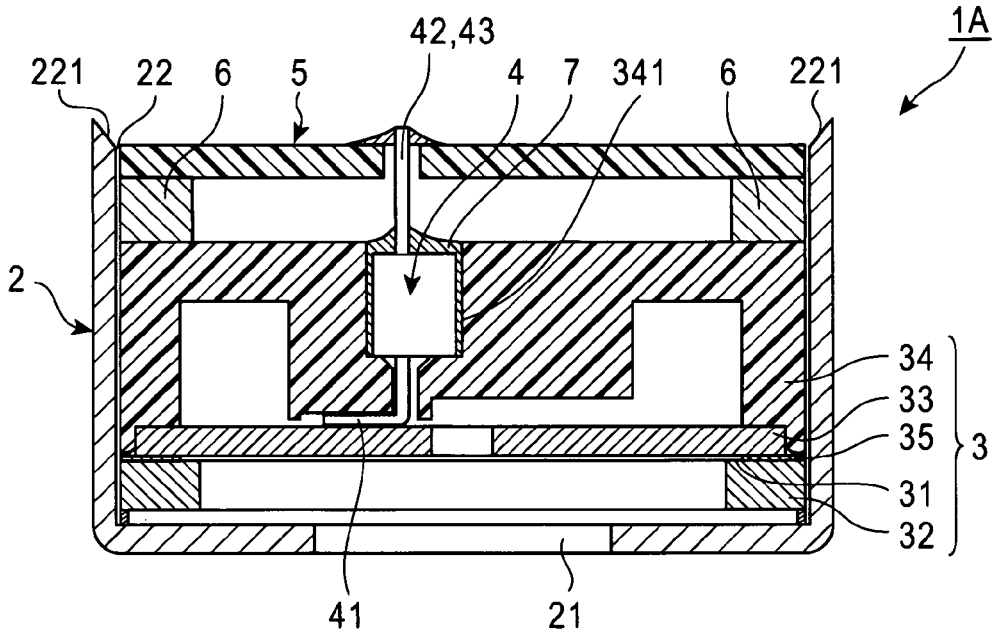
FIG. 3 RELATED ART
FIG. 3 is a schematic sectional view showing a state before a condenser microphone unit in accordance with a conventional example is staked.
Figure 4:
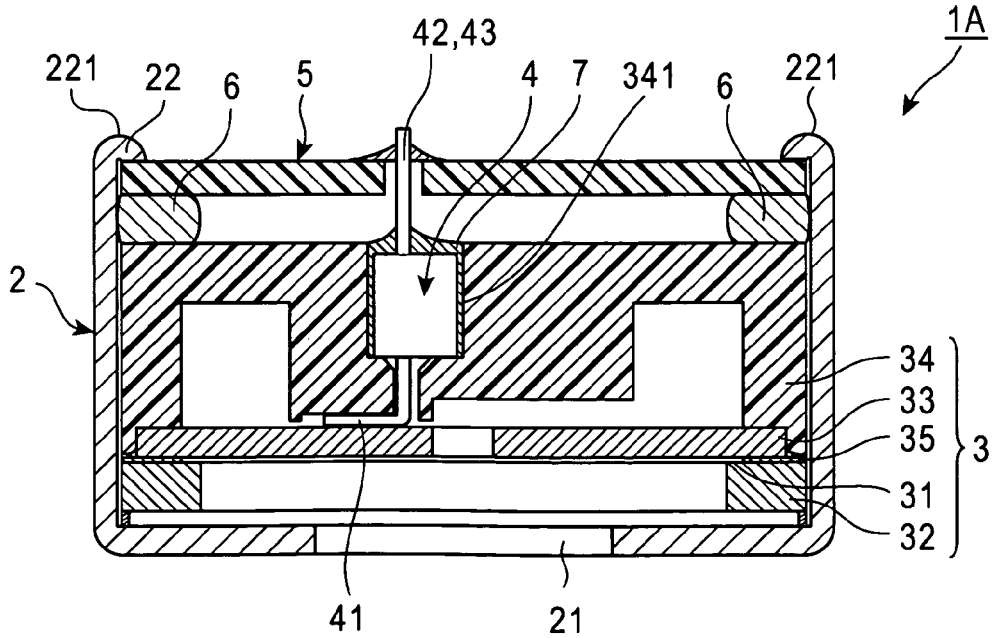
FIG. 4 RELATED ART
FIG. 4 is a schematic sectional view showing a state before a condenser microphone unit in accordance with a conventional example has been staked.

An embodiment of the present invention will now be described with reference to FIGS. 1 and 2. The present invention is not limited to this embodiment. In the following description, the same reference numerals are applied to elements that are the same or are regarded as the same as the elements in the conventional example described with reference to FIGS. 3 and 4.

Figure 1:
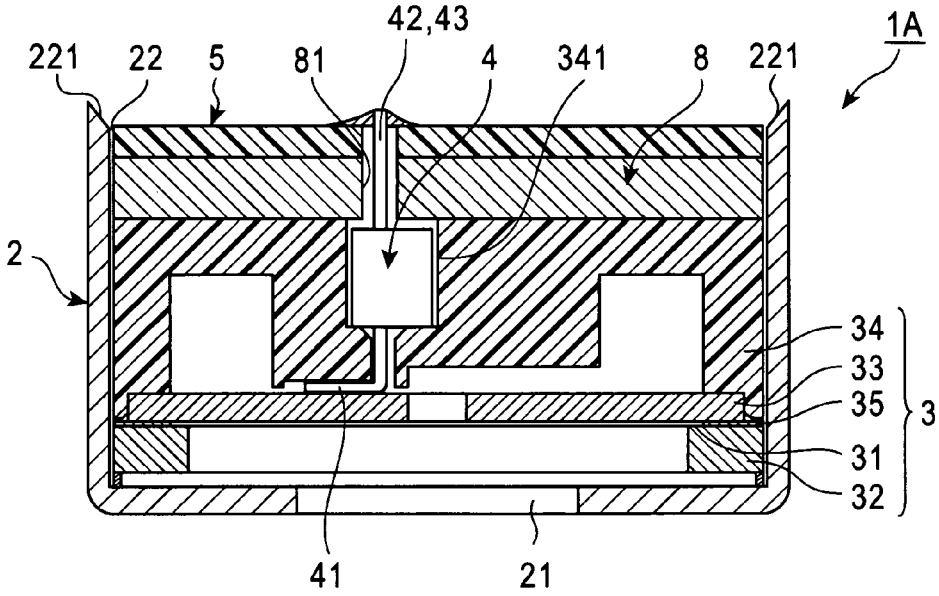
FIG. 1 is a schematic sectional view showing a state before a condenser microphone unit in accordance with an embodiment of the present invention is staked.

Referring to FIG. 1, like the conventional example, a condenser microphone unit 1A in accordance with this embodiment also has a bottomed cylindrical unit case 2, and an acousto-electric converter 3 is accommodated in the unit case 2.

The unit case 2 is formed by a press-molded product of a metallic material such as aluminum, and is provided with a front acoustic terminal 21 on the front end surface side thereof (the surface side directed to the sound source side when sound is picked up) corresponding to a bottom part. The rear end surface side of the unit case 2 forms an opening part 22 through which the acousto-electric converter 3 is accommodated. This condenser microphone unit 1A is also ominidirectional because of having no rear acoustic terminal.

The acousto-electric converter 3 includes a diaphragm 31 stretchedly provided on a support ring (diaphragm ring) 32 and a backplate 33 fixed on the front surface side (in FIG. 1, on the lower surface side) of a cylindrical insulating seat 34 formed of a synthetic resin, and the diaphragm 31 and the backplate 33 are disposed so as to face each other via a spacer ring 35.

In this embodiment, a recess 341 is formed on the rear surface side of the insulating seat 34, and a FET (field effect transistor) 4, which is an impedance converter for the acousto-electric converter 3, is accommodated in the recess 341. The FET may be disposed directly on the rear surface of the insulating seat 34 without the recess 341 formed on the rear surface side of the insulating seat 34.

The FET 4 includes a gate electrode 41, a drain electrode 42, and a source electrode 43. Among these electrodes, the gate electrode 41 is electrically connected to the backplate 33. In FIGS. 1 and 2 as well, only one of the drain electrode 42 and the source electrode 43 is shown in the figures because these elements are located at lapping positions on the drawing.

In the opening part 22 on the rear end surface side of the unit case 2, a circuit board 5 is disposed so as to close the opening part 22. Although not shown in the figures, the circuit board 5 is formed with solder lands to which the drain electrode 42 and the source electrode 43 are soldered and a ground (earth) pattern, to which a microphone cable is connected.

As the microphone cable, a two-core shield covered wire is used. The feed line thereof is soldered to the solder land of the drain electrode 42, the signal line thereof is soldered to the solder land for the source electrode 43, and the shield covered wire (braided wire) is soldered to the ground pattern.

According to the present invention, between the rear surface side of the insulating seat 34 and the circuit board 5, an elastic gel-form ferrite sheet 8, which is used as both of an elastic sealing member and an electromagnetic shielding member, is disposed. As this gel-form ferrite sheet 8, the gel-form ferrite sheet GE series (trade name) manufactured by FDK CORPORATION can be cited exemplarily.

The gel-form ferrite sheet 8 is formed in a disc shape having an outside diameter approximately equal to the inside diameter of the unit case 2, and is disposed in the unit case 2 in such a manner that insertion holes 81 for allowing the drain electrode 42 and the source electrode 43 to pass through are provided. The insertion holes 81 are preferably provided individually for the drain electrode 42 and the source electrode 43. However, one insertion hole 81 may be provided as an elongated hole for both the electrodes.

The condenser microphone unit 1A is assembled as described below. First, the acousto-electric converter 3 is housed in the unit case 2, thereafter the gel-form ferrite sheet 8 being displaced on the rear surface side (in FIG. 1, on the upper surface side) of the insulating seat 34, and the circuit board 5 is disposed on the gel-form ferrite sheet 8 while the drain electrode 42 and the source electrode 43 are inserted therethrough.

Figure 2:
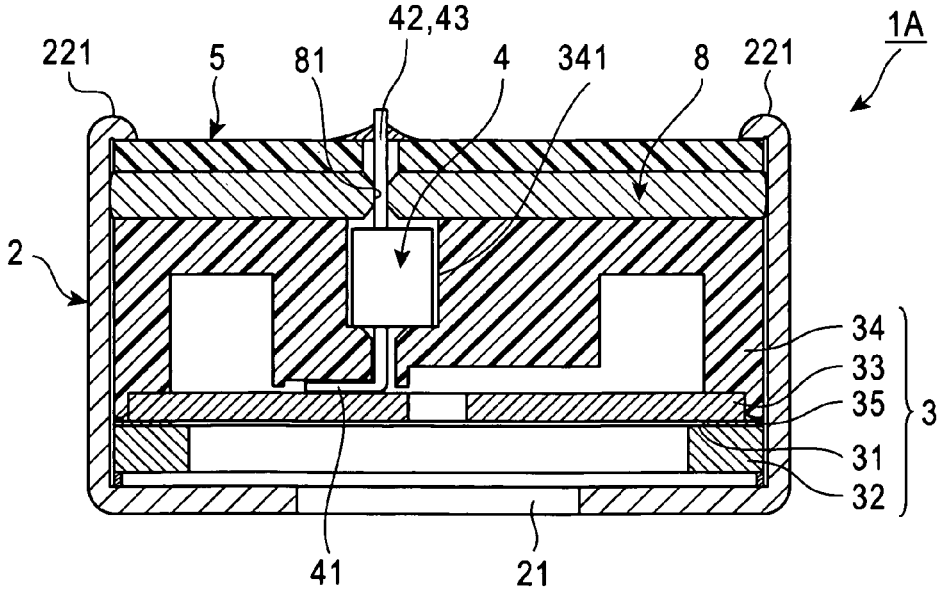
FIG. 2 is a schematic sectional view showing a state after a condenser microphone unit in accordance with an embodiment of the present invention has been staked.

Then, after an edge 221 of the opening part 22 on the rear surface side is staked while being curled toward the inside as shown in FIG. 2, the drain electrode 42 and the source electrode 43 are soldered to the circuit board 5. Thereby, the gel-form ferrite sheet 8 is compressed to a proper degree, and incorporated parts including the acousto-electric converter 3 and the circuit board 5 are fixed in the unit case 2.

As the gel-form ferrite sheet 8 is compressed, the inner peripheral surface of the insertion holes 81 come into close contact with the peripheries of the drain electrode 42 and the source electrode 43. Thereby, the intrusion of a high-frequency current from the microphone cable side is inhibited by the magnetism (inductance) that the gel-form ferrite sheet 8 has.

In order to effectively inhibit the intrusion of the high-frequency current from the microphone cable side, a condenser element for high-frequency short circuit is preferably mounted on the circuit board 5.

As a result of being compressed, the gel-form ferrite sheet 8 spreads in the radial direction and comes into close contact with the inner surface of the unit case 2. Therefore, the opening part 22 on the rear surface side of the unit case 2 is sealed airtightly, and sound waves can be preventing from leaking.

Since the gel-form ferrite sheet 8 is formed in a disc shape, not in a ring shape that has been used in the conventional example, at the time of fixation accomplished by staking or the like means, a steady internal stress can be applied to the incorporated parts almost uniformly.

In the gel-form ferrite sheet 8, ferrite powder is mixed as magnetic powder. Instead of the ferrite powder, a magnetic material such as chromium oxide or cobalt may be used as far as a high-frequency current can be inhibited by the magnetism (inductance).

Therefore, in the present invention, a gel-form chromium oxide sheet or a gel-form cobalt sheet is also embraced as an equivalent of the gel-form ferrite sheet 8.

In the above-described embodiment, in fixing the incorporated parts (3, 5) in the unit case 2, the rear edge 221 of the unit case 2 is staked. However, the incorporated parts (3, 5) may be fixed by forming internal threads on the inner surface of the unit case 2 and by threadedly engaging a lock ring having external threads with the internal threads.

The invention claimed is:

1. A condenser microphone unit comprising a unit case which has a front acoustic terminal hole on the front end surface side thereof and is open on the rear end surface side thereof, in which the unit case incorporates an acousto-electric converter comprising a diaphragm stretchedly provided on a support ring and a backplate supported on the front surface side of an insulating seat, the diaphragm and the backplate being arranged so as to face each other via a spacer member, and an impedance converter; a circuit board is disposed in an opening part on the rear end surface side of the unit case;

and incorporated parts including the acousto-electric converter and the circuit board are fixed into the unit case, wherein an elastic gel-form ferrite sheet having an outside diameter approximately equal to the inside diameter of the unit case is held between the insulating seat and the circuit board.

2. The condenser microphone unit according to claim 1, wherein the impedance converter is disposed in the insulating seat, and a predetermined electrode lead of the impedance converter is connected to the circuit board through the gel-form ferrite sheet.

3. The condenser microphone unit according to claim 1, wherein a condenser element for high-frequency short circuit is mounted on the circuit board.

4. The condenser microphone unit according to claim 1, wherein instead of the staking of the edge of the opening part or by a lock ring threadedly engaged with the unit case.

* * * * *